United States Patent [19]

Francis et al.

[11] Patent Number: 4,753,828

[45] Date of Patent: Jun. 28, 1988

[54] COLOR CHANGEABLE EARRINGS

[76] Inventors: Michele Francis, 23 Spindletop La., Willingboro, N.J. 08046; Francis J. Dignam, 30-22 Quail Ridge Dr., Plainsboro, N.J. 08536

[21] Appl. No.: 944,994

[22] Filed: Dec. 22, 1986

[51] Int. Cl.[4] ..... B05D 1/28; B05D 3/02

[52] U.S. Cl. ..... 427/260; 63/2; 63/12; 427/262; 427/307; 427/384; 118/500; 206/581; 428/28

[58] Field of Search ..... 63/2,29 R, 30, DIG. 3; 427/262, 260, 384, 385.5; 29/160.6; 264/DIG. 55; 434/98; 118/500, 300; 206/575, 581, 566

[56] References Cited

U.S. PATENT DOCUMENTS

| | | | |
|---|---|---|---|
| 2,014,414 | 9/1935 | Schneeweis | 63/DIG. 3 |
| 2,515,359 | 7/1950 | Steiner | 118/500 |
| 3,997,686 | 12/1976 | McClure | 118/500 |
| 4,295,347 | 10/1981 | Visconti | 63/DIG. 3 |
| 4,388,350 | 6/1983 | Ayers | 427/270 |
| 4,448,304 | 5/1984 | Weinzettel | 63/30 |
| 4,498,314 | 2/1985 | Okamura | 63/2 |
| 4,533,051 | 8/1985 | Fleming | 206/581 |
| 4,693,205 | 9/1987 | Thill | 428/15 |

FOREIGN PATENT DOCUMENTS

| | | | |
|---|---|---|---|
| 216524 | 6/1958 | United Kingdom | 63/DIG. 3 |

*Primary Examiner*—Richard J. Johnson
*Attorney, Agent, or Firm*—William Lawrence Muckelroy

[57] ABSTRACT

An earring having a changeable hand painted image thereon wherein a user's nail polish is used to hand paint the image on the surface of the earring such that the surface matches that of the user's hand painted nails and method for making the novel earring which utilizes a specially adapted stand for holding the earring and retaining same while the earring is hand painted.

2 Claims, 2 Drawing Sheets

COLOR CHANGEABLE EARRINGS

BACKGROUND OF THE INVENTION

1. Field of the Invention

The present invention relates generally to costume jewelry, and more particularly to a color changeable article of jewelry, such as an earring, which is adapted to display a color which matches the wearer's fingernail polish.

2. Description of the Prior Art

In the past, owners of articles of jewelry such as colorful costume earrings and the like, were compelled to have a number of entirely different earrings, each of which was most complimentary to a particular color coordinated clothing ensemble.

Accordingly, if a woman desired to wear pink nail polish with a complimenting pair of earrings also displaying the same color as her nail polish, the only way that she could wear earrings displaying the same color as her nail polish with each color of nail polish would be to have a separate pair of earrings for each color of polish. Further, sometimes there is extreme difficulty finding earrings which match the myriad of colors of nail polish available today. Moreover, it has been commonplace for some time now for women to wear lipstick and nail polish which compliment each other with a matching color.

As early as 1934, Hamberg invented an artificial colorable fingernail, as disclosed in U.S. Pat. No. 1,942,332. Hamberg provided a member shaped similar to a fingernail which could be mounted upon the natural fingernail and attached thereto by any suitable securing means such as glue, the member being formed as the exterior thereof to project beyond the end of the finger. The Hamberg nail was adapted to have a portion thereof selectively colored and the remaining portion thereof either colored or uncolored so as to simulate a relatively long pointed fingernail.

Lawrence in U.S. Pat. No. 3,605,438 entitled "Bar Pen with Changeable Non-Rotably Secured Ornament in Intermediate Member" as issued on Sept. 20, 1971, provided an article of jewely such as an earring which could be converted or modified from time to time. This provided a more utilitarian earring which could be worn more frequently without any feeling of repetition and without the user's peers realizing that it was the same article. Lawrence provided an earring which was convertible wherein the central portion thereof, which could consist of diamonds, sapphires, opals or the like, could be utilized with a multiplicity of decorative bases so as to be usable with a greater variety of clothing.

Van Deusen, in U.S. Pat. No. 3,785,912 issued on Jan. 15, 1974 and entitled "Jewely Design Kit and Method for Design", provided a jewelry design and coloring kit and method for designing jewelry comprising of a plurality of transfer sheets, each sheet containing a plurality of jewelry elements such as, for example, diamonds, pearls, etc.; a means for transferring the jewels from the transfer sheets to a work sheet; and a plurality of pens utilized for coloring the jewelry.

Berry, et al., in U.S. Pat. No. 4,534,185 issued on Aug. 13, 1985 entitled "Ear Frame", provided an earring having an interchangeable message card on one side of a pad suspended from a chain led by a clip from a wearer's ear.

As evinced by the foregoing, purchasers of jewelry in recent years have increasingly demanded personalized service and exclusive creations.

There is a need in the costume jewelry and cosmetic business to provide a means for enabling a woman to readily create an earring which either closely matches her clothing, her fingernail polish, and/or her lipstick. The present invention satisfies this need. It overcomes the limitations and shortcomings of the prior art by a novel earring design kit and method of design which substantially satisfies the need in the market place for earrings which match in color other painting applied to portions of a woman's body.

The present invention can also be of substantial benefit to the professional designer in the jewelry field or to the cosmetics designer in that it provides an additional marketing line and market concept. The novel invention addresses the need for intricate, yet unique, painting of earrings by the user with an appropriate color to match the lipstick and/or fingernail polish. In addition, the method and kit of the present invention are simple and convenient.

SUMMARY OF THE INVENTION

The present invention is an earring design kit, method for coloring earrings to match fingernail polish and/or matching lipstick and a novel earring. The kit is comprised of one pair of earrings each having a front piece of a predetermined shape; a backing attached to the front piece; a stand adapted to hold the earring such that it can be painted. Each novel earring has a front face adapted to receive a hand painted image and a hand painted image on the face of the front piece which is removeable and replaceable.

OBJECTS OF THE INVENTION

It is a principal object of this invention to enable ordinary persons to create uniquely designed earrings depicting a color which matches the person's lipstick and/or nail polish simply, conveniently and quickly.

It is another principal object of this invention to provide a means and method for making uniquely colored earrings.

It is another object of this invention to provide individuals a highly flexible and time-saving means of obtaining unique and artistic colorful earrings which match the persons fingernail polish.

Other objects, novel features and advantages of the present invention will become apparent upon making reference to the following detailed description of the novel invention and the accompanying drawings. The description and the drawings will also further disclose the novel characteristics of this invention, both as to its structure and its method. Although a preferred embodiment and preferred method of the invention are described herein below, and shown in the accompanying drawings, it is expressly understood that the descriptions and drawings thereof are for the purpose of illustration only and do not limit the scope of this invention.

DETAILED DESCRIPTION OF THE INVENTION

With reference to FIGS. 1 through 6, the present invention will be described in detail by describing the preferred embodiment of the novel earring, a preferred embodiment of the earring kit, and a preferred method for making the novel earring. Like elements appearing in the several figures will be designated by like numerals.

Figure 1:
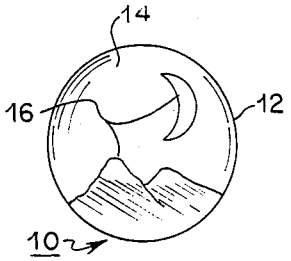
FIG. 1 is a front plan view of the novel earring embodied in a circular face front piece with an exemplary design painted thereon.
Figure 2:
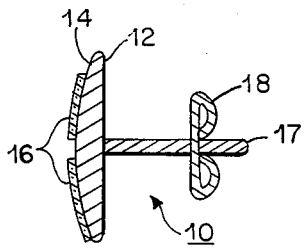
FIG. 2 is a side view of the novel earring of FIG. 1.

In FIG. 1 there is shown an earring 10 having a front piece 12. The front piece 12 has a face 14 adapted to receive a hand painted image 16. A side view of the earring 10 is shown in FIG. 2. There, the front piece 12 is shown with a post 17 extending from the front piece 12 and a backing member 18 adapted to hold said front piece 12 adjacent an earlobe (not shown).

The front piece 12, the post 17 and the backing member 18 may be made of any commonly known metal alloy such as, for example, brass, plumb gold or a silver-based alloy. Alternatively, the entire earring may be made of plastic.

The hand painted image 16 may be designed to cover either a part or all of the face 14 of the front piece 12 in accordance with any design hand painted by the wearer of the earring 10.

Figure 3:
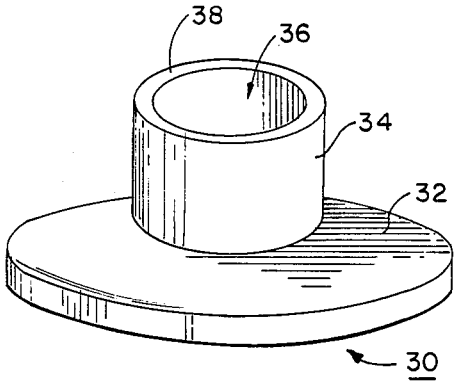
FIG. 3 is a stand used to hold the novel earring, shown in FIGS. 1 and 2, such that a design utilizing fingernail polish or paint may be painted on the surface of the piece.
Figure 4:
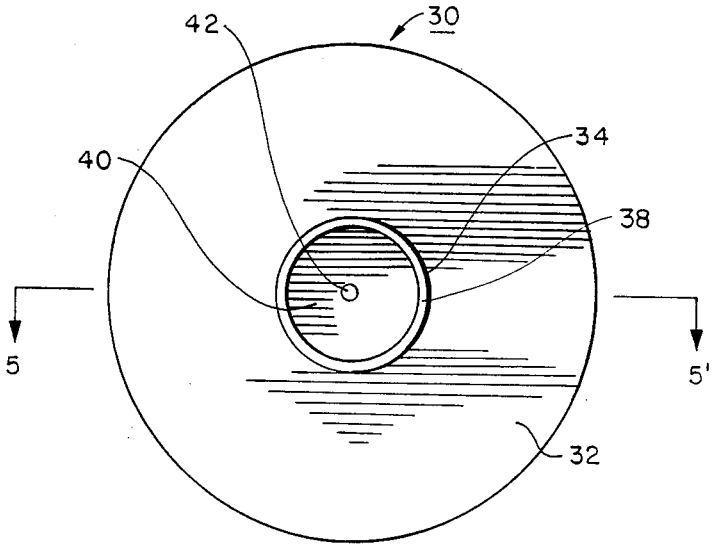
FIG. 4 is a top view of the stand shown in FIG. 3.

Shown in FIG. 3, is a stand 30 adapted to firmly, rigidly, and detachably hold the front piece 12 via an integral holding member 40 (shown in FIG. 4) in the same manner as the backing member 18, shown in FIG. 2. The stand 30 is adapted to hold the front piece 12 by means of a rigidly fixed hole 42 (shown in FIG. 4) for the post 17. The stand 30 is made of a base member 32 having integrally attached thereto an upright receiving member 34 with an aperture 36 therein. The aperture 36 is adapted such that it has a lip 38 upon which the front piece 12 rests when the post 17 of the front piece 12 is inserted into the aperture 36. The stand 30 may be made of a heavy plastic or a metal alloy such as brass, for example, FIG. 4 shows a top view of the stand 30. There is shown the base 32. The lip 38 of the receiving member 34 is shown in plan view. Recessed within the receiving member 34 is the integral holding member 40 with the fixed hole 42 having a diameter selected to firmly retain the post 17 of the front piece 12.

Figure 5:
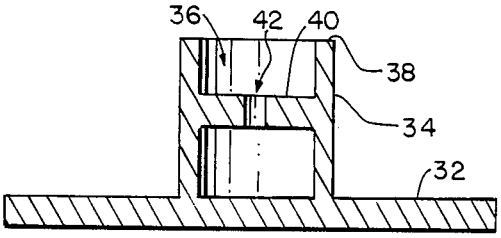
FIG. 5 is a cross-section of the stand, shown in FIGS. 3 and 4, showing a retaining means for the front piece of the earring during painting.

FIG. 5 is a cross-sectional view of the stand shown in plan view in FIG. 4 taken along the plane 5-5'. There is shown the base member 32 attached integrally to receiving member 34. The receiving member 34 is shown with the holding member 40 integrally attached thereto. The aperture 36 is partially blinded by the holding member 40.

Figure 6:
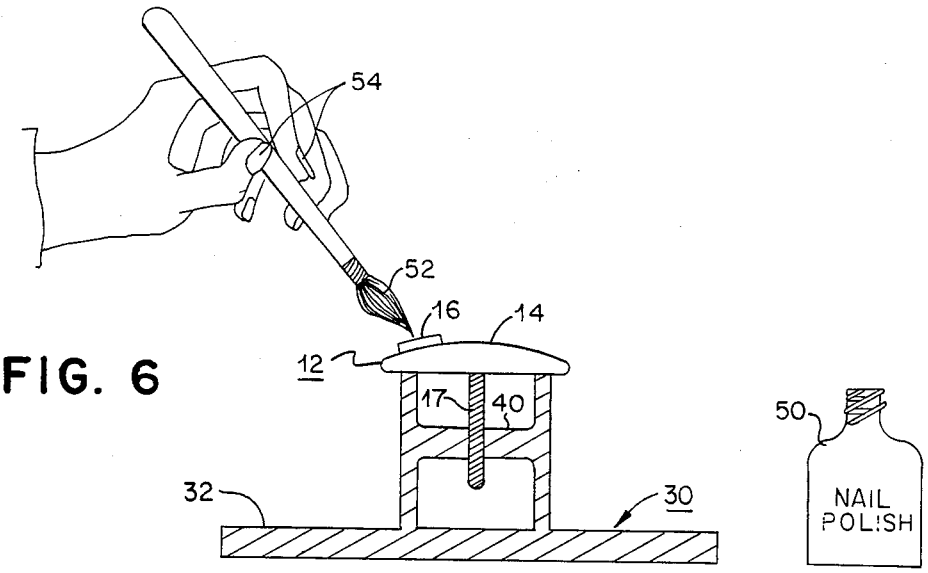
FIG. 6 shows the stand of FIG. 3 being utilized in the method of the invention to create a painted design, such as shown in FIG. 1, on the front piece of the novel earring.

In FIG. 6 there is shown a cross-section of the stand 30 in use. The earring 10 is shown firmly held in the stand 30 by means of a retaining means such as the holding member 40. The holding member 40 holds the post 17 in the stand 30. A design is painted on the face 14 of the front piece 12. A user uses common nail polish such as, for example, the polish 50. The polish 50 is applied to the face 14, for example, by a brush 52. The brush 52 may be either a nail brush which accompanies the nail polish 50 or some other brush designed to give a particular stroke or texture to a hand painted image such as, for example, the image 16 shown in FIG. 1.

The present novel invention includes a method for making an earring such as the earring 10 as shown in FIG. 1, for example. The earring 10 shown in FIG. 1 displays a portion of its face 14 painted with an image 16 which has the same color as a wearer's fingernails 54, as shown in FIG. 6. The image 16, as shown in FIG. 6, is painted with the same nail polish 50 as is used to paint the fingernails 54 shown in FIG. 6. The earring 10, as shown in FIG. 2 for example, is adapted to be used in the method wherein the earring 10 has its face 14 adapted to be painted with the nail polish 50, as shown in FIG. 6, so as to form a hand painted image 16 on the face 14 of the front piece 12.

The next step in the method is to hold the earring 10 in a stand 30, such as is shown in FIG. 6, and in the manner shown in FIG. 6. As shown, the stand 30 is adapted within the method to retain the earring 10 with the face 14 free for hand painting of a hand painted image 16 using the nail polish 50, for example.

The next step is the actual painting of the face 14 of the front piece 12 using, for example, the brush 52 to apply nail polish 50. Once the image is hand painted on the face 14 of the front piece 12 of the earring 10, it is allowed to dry and appropriately adhere and harden on the face 14 of the front piece 12.

The preferred method of creating earrings having hand painted images thereon which match the color of nail polish further comprises a method for altering the surface of the earring so as to allow it to match a newly chosen or differently chosen nail polish cover such as the polish 50, for example. First, fingernail polish remover is applied to the face 14 of the front piece 12 and the hand painted image 16, comprised of fingernail polish 50, is removed from the face 14. Once the face 14 has the image 16 removed therefrom, it may be repainted using fingernail polish such as, for example, the polish 50 of another color.

For earrings 10 comprised of non-acetone resistant material such as plastic, for example, a non-acetone based polish remover is used such as, for example, the type used to remove polish from artificial nails.

Once the face 14 is repainted with another nail polish, for example, the polish 50, the repainted face 14, with the image 16 thereon, is allowed to thoroughly dry by drying the face 14 of the earring 10 with a suitable means such as, for example, a sprayed drying agent (not shown) commonly used to dry fingernails.

Two or more different colors of the fingernail polish 50 may be intermingled and intertwined on the face 14 in an appropriate pattern selected by the wearer wherein either one or more of the fingernail polish colors on the face 14 matches one or more similar colors of the same fingernail polish applied to the fingernails 54. Thus, a method is provided for providing earrings and applying artful designs which are color coordinated with the painted color or colors of the fingernails.

Although this invention has been disclosed and described with reference to a particular embodiment and method, the principles involved are susceptible of other applications which will be apparent to persons skilled in this art. This invention, therefore, it not intended to be limited to the particular embodiment and method herein disclosed but to such embodiments and methods as are encompassed by the scope of the claims pursuant to the applicability of the doctrine of equivalents.

What is claimed is:

1. A method for making an earring which displays a surface having the same color as a user's nail painted with a particular nail polish comprising the steps of:

Providing an earring with a face adapted to be painted with said nail polish;

Holding said earring in a stand adapted to retain said earring with said face free to be hand painted;

Painting said face with said nail polish; and,

Drying the painted face of the earring.

2. The method of claim 1 further comprising the additional steps of:

Applying polish remover to said face;

Removing said hand painted image from said face;

Repainting said face with another nail polish; and,

Drying the painted face of the earring.

* * * * *